US005704783A

United States Patent [19]

Heuss

[11] Patent Number: 5,704,783

[45] Date of Patent: Jan. 6, 1998

[54] WALKING HEARTH FURNACE

[75] Inventor: Helmut Heuss, Ratingen, Germany

[73] Assignee: Thermoprocess GmbH, Essen, Germany

[21] Appl. No.: 740,080

[22] Filed: Oct. 24, 1996

Related U.S. Application Data

[63] Continuation of Ser. No. 413,540, Mar. 30, 1985, abandoned.

[30] Foreign Application Priority Data

Mar. 31, 1994 [DE] Germany ..... 44 11 216.5

[51] Int. Cl.[6] ..... F27D 3/02

[52] U.S. Cl. ..... 432/234; 432/122; 432/128

[58] Field of Search ..... 198/774.2, 774.4; 432/122, 123, 128, 133; 437/121, 234

[56] References Cited

U.S. PATENT DOCUMENTS 4,330,262 5/1982 Kranzi et al. ..... 432/122
5,405,264 4/1995 Heuss ..... 432/234

*Primary Examiner*—Noah P. Kamen
*Attorney, Agent, or Firm*—Blakely Sokoloff Taylor & Zafman

[57] ABSTRACT

A walking hearth furnace comprising fixed and walking hearths (1 to 3 respectively 4,5) on the refractory lining of which the work (6) is placed. Slanted surfaces are worked into the refractory lining forming depressions (15) and causing the work to be heated from underneath. The pieces of work are arranged in such a manner that spaces form between them, through which the heat from above can act on the slanted surfaces. Furthermore, the slanted surfaces serve to remove the scale both through the slots between the hearths and through scale chutes (16) which lead downwards out of the depressions (15) and operate in conjunction with scale removal devices (22).

20 Claims, 4 Drawing Sheets

WALKING HEARTH FURNACE

CROSS-REFERENCES TO RELATED APPLICATIONS

This is a continuation of a U.S. patent application (application Ser. No. 08/413,540) filed Mar. 30, 1995, now abandoned.

BACKGROUND OF THE INVENTION

1. Field of the Invention

The present invention relates to a walking hearth furnace for reheating work, in particular metal slabs, blooms, billets and the like. The walking furnace comprises at least one fixed hearth and one walking hearth, the hearths running in the longitudinal direction of the furnace and being provided with a refractory lining, and a heating device arranged above the hearths and causing the work to be heated from above.

2. Prior art

The dimensions of the pieces of work determine the number of walking hearths and fixed hearths arranged alternately next to each other. The pieces of work are transported from the furnace charging end to the furnace discharge end by the walking hearths. The walking furnace lift the pieces of work above the level of the fixed hearths and move them forwards in the direction of the furnace discharge end by a predetermined amount. The walking hearths are returned to their original position below the level of the fixed hearths. The number of and time intervals between the walking hearth travel cycles depends on the required heating period for the work. The working principle of the walking hearth furnace is therefore the same as that of the walking beam furnace.

The advantages of the walking hearth furnace over the walking beam furnace are that the work can be transported very carefully and can above all be supported at short distances. Therefore, it is possible to convey and reheat very thin cross-sections which would sag if the distances were greater. Furthermore, there are no heat losses through water-cooled tubular supports, fixed supports and legs. Therefore, energy consumption is particularly low.

However, there is no underfiring which is customary with walking beam furnaces. This leads to problems when reheating thicker cross-sections and the hearth capacity is also lower.

SUMMARY OF THE INVENTION

It is an object of the present invention to improve the reheating of work in walking hearth furnaces in a simple and economic manner.

The present invention therefore proposes a walking hearth furnace wherein the refractory lining of the hearths exhibits slanted surfaces in the hearth area. These slanted surfaces are used as secondary heating surfaces to enable the work to be heated from underneath.

Thus the walking hearth furnace permits underfiring of the charge which is normally only possible with walking beam furnaces. Nevertheless, the other intrinsic advantages of the walking hearth furnace are retained. Every time the slanted surfaces are exposed they are heated from above. At the same time, a hot gas cushion forms above the slanted surfaces. The heat stored in the slanted surfaces and in the hot gas cushion can then be given off to the pieces of work from below. Overall, this increases thermal efficiency and improves heat penetration of the pieces of work. Therefore, it is also possible to reheat thicker cross-sections.

The slanted surfaces are preferably limited in size to configure the depressions to employ scale chutes that pass scale downwards through the hearths. This prevents the scale which unavoidably forms being deposited on the hearth area and disrupting furnace operation or even preventing it when the scale reaches the same height or exceeds the height of stroke of the walking hearths.

It is particularly advantageous for scale removal devices to be located below the scale chutes so that the scale can automatically be removed either continually or intermittently.

The angle of inclination of the slanted surfaces preferably corresponds at least to the angle of repose of the scale falling from the pieces of work to avoid the scale adhering to the slanted surfaces.

Further it is advantageous for the depressions to be arranged such that the hearth area is sub-divided into sections which are offset in relation to each other transverse to the longitudinal direction of the furnace. Thus, during travel through the furnace, the surface carrying the work shifts periodically transverse to the longitudinal direction of the furnace. The heat from below given off by the slanted surfaces is therefore spread more uniformly over the bottom of the pieces of work so that heat penetration is more even.

Some of the slanted surfaces preferably each lead to one of the slots between the fixed and walking hearths. The scale sliding down from these slanted surfaces is transported away by the slot scale removal devices always present so that additional scale removal devices are only necessary for the scale chutes.

It has been shown that particularly effective heating of the work from below is achieved when some of the slanted surfaces are inclined substantially in the longitudinal direction of the furnace and other slanted surfaces are inclined substantially transverse thereto. The depressions formed by the slanted surfaces have, at the level of the hearth area, a square cross-section which tapers downwards in the form of a pyramid and leads to the scale chute which is located at the bottom of the depression. It is particularly advantageous to choose an arrangement in which the depressions limited by the slanted surfaces are adjacent to each in the longitudinal direction of the furnace.

In a further embodiment proposed by the present invention, the slanted surfaces inclined substantially in the longitudinal direction of the furnace form bridges whose height is below the hearth area of the refractory lining carrying the charge. Therefore, when viewed from the longitudinal direction of the furnace, rows of depressions are formed, these depressions being connected to each other in the vicinity of the hearth area and permitting passage of hot gases in the longitudinal direction of the furnace.

It is particularly advantageous if at least some of the slanted surfaces are provided with an additional heating device as then the hot gases of this additional heating device can pass off. The additional heating device supports the effect of heating from below by the slanted surfaces.

A further embodiment of the present invention proposes a walking hearth furnace wherein a control device is provided for charging the hearth areas with work in such a manner that the pieces of work are spaced apart from each other and therefore the effect of the heat from above on the slanted surfaces is intensified. The control device is preferably provided with a computer to optimise reheating. This optimisation not only covers the arrangement of the pieces of work on the hearth area but also the travel cycle and if desired the length of the conveyance steps.

BRIEF DESCRIPTION OF THE DRAWINGS

The present invention will now be described in a non-limitative way with the help of preferred embodiments illustrated in the accompanying drawing, in which.

DETAILED DESCRIPTION OF THE INVENTION

Figure 2:
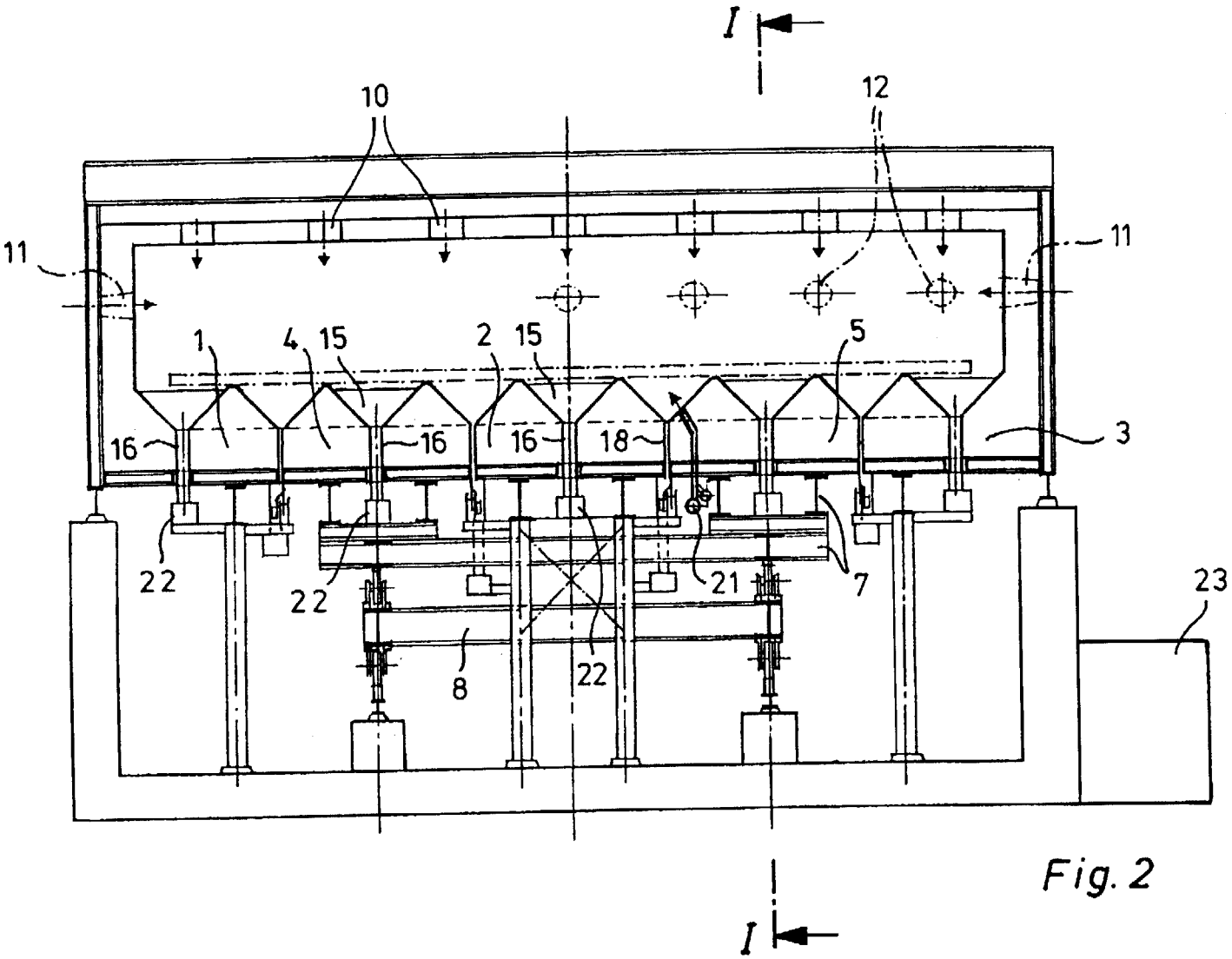
FIG. 2 is a vertical cross-section of the furnace along line II—II in FIG. 1.

The embodiment of the present invention depicted in FIG. 2 shows a walking hearth furnace comprising three fixed hearths 1, 2 and 3 and therebetween two walking hearths 4 and 5. Long pieces of work 6 laid transverse to the longitudinal direction of the furnace are conveyed.

Figure 1:
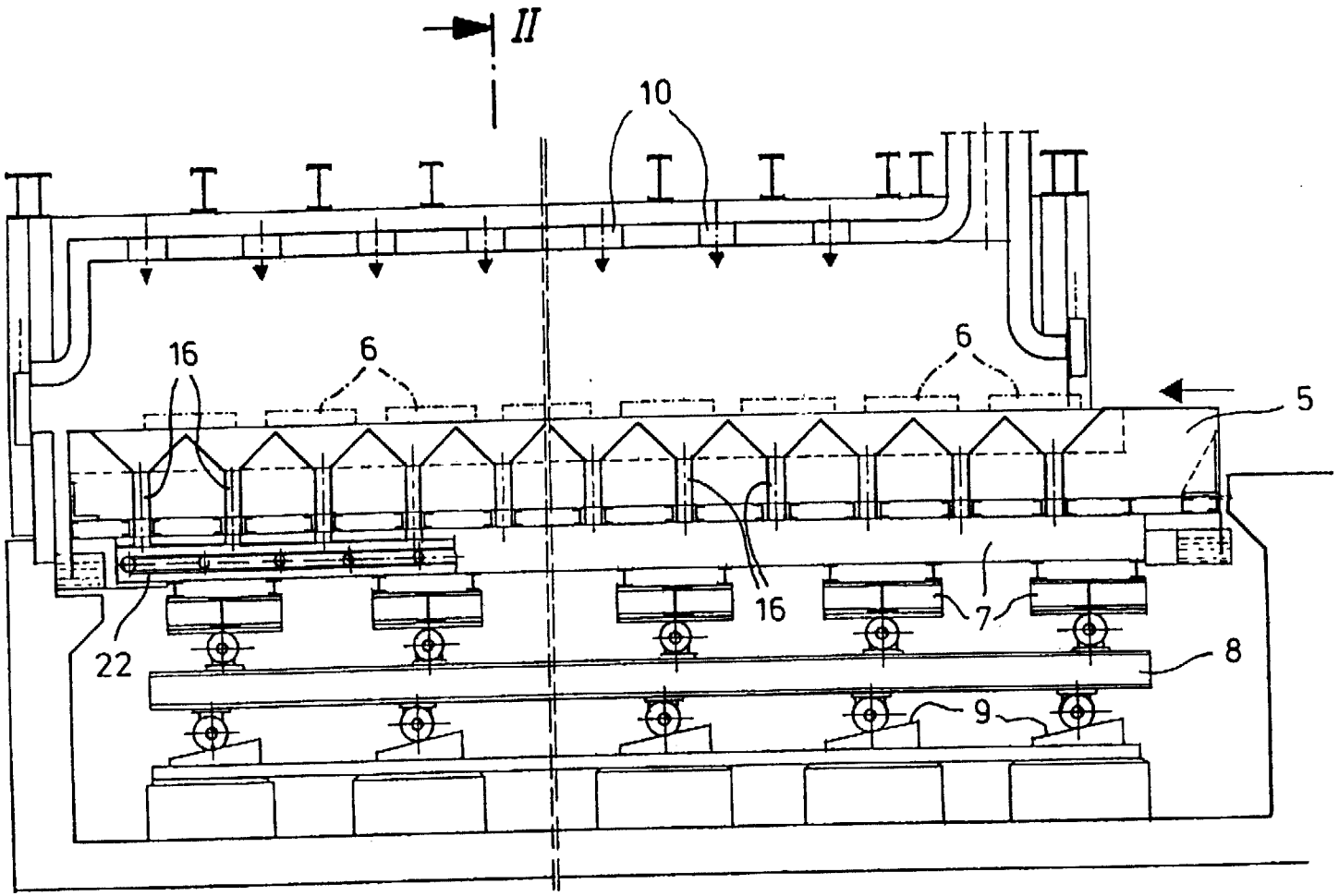
FIG. 1 is a vertical longitudinal section of a walking hearth furnace along line I—I in FIG. 2.

The manner of conveyance is best seen from FIG. 1. The walking hearth 5 rests on a travelling frame 7 which can be moved horizontally on a lifting frame 8. The lifting frame 8 can also be moved horizontally but due to the effect of the slanted surfaces 9 performs vertical movements which lifts and lowers the traveling frame 7, and thus the walking hearth 5. The pieces of work 6 are lifted, conveyed in the direction of the furnace discharge end and lowered again onto the fixed hearths in steps, the travelling hearth then returning to its original position below the surface level of the hearth. As can be seen from FIG. 2, the walking hearths 4 and 5 are coordinated in their movements with each other.

Referring still to FIG. 1, the furnace is heated by a heating device which optionally comprises top burners 10, side wall burners 11, end wall burners 12 or a combination thereof. This results primarily in heating of a top surface of the work.

Based on the design of the hearth area according to the present invention, heating of the work 6 from below is also achieved. According to FIG. 3, the fixed hearth 3 has a number of slanted surfaces 13 which are inclined in the longitudinal direction of the furnace. Furthermore, the fixed hearth 3 is provided with slanted surfaces 14 which are inclined transverse to the longitudinal direction of the furnace. Four slanted surfaces form a depression 15 at the bottom of which a scale chute 16 is provided. Another slanted surface 17 inclined transverse to the longitudinal direction of the furnace leads to a slot 18 which is provided between the fixed hearth 3 and the walking hearth 5. The actual hearth area of the fixed hearth 3 is formed by a flattened edge which is shown in FIGS. 3 to 7 as line 19.

Referring now to FIGS. 4–7, the cycled conveyance of the work 6 in the longitudinal direction of the furnace is shown. A comparison of these Figures shows that the depressions 15 formed by the slanted surfaces 13 and 14 are constantly exposed to heat from above. They are also continually filled with hot gas. In this manner the slanted surfaces 13 and 14 cause the pieces of work 6 to be heated from below so that the heat penetration of the work is rapid and uniform.

In the explanations given hereinabove, reference was only made to the fixed hearth 3. However, these explanations also apply to the other fixed hearths and to the two walking hearths, the only difference being that the hearths 2, 4 and 5 have slanted surfaces 17 on both longitudinal sides.

Referring still to FIGS. 4–7, the arrows indicate the heat radiating from the heating devices arranged above, the maximum slanted surface area heated being marked by a dotted line in each case.

Figure 3:
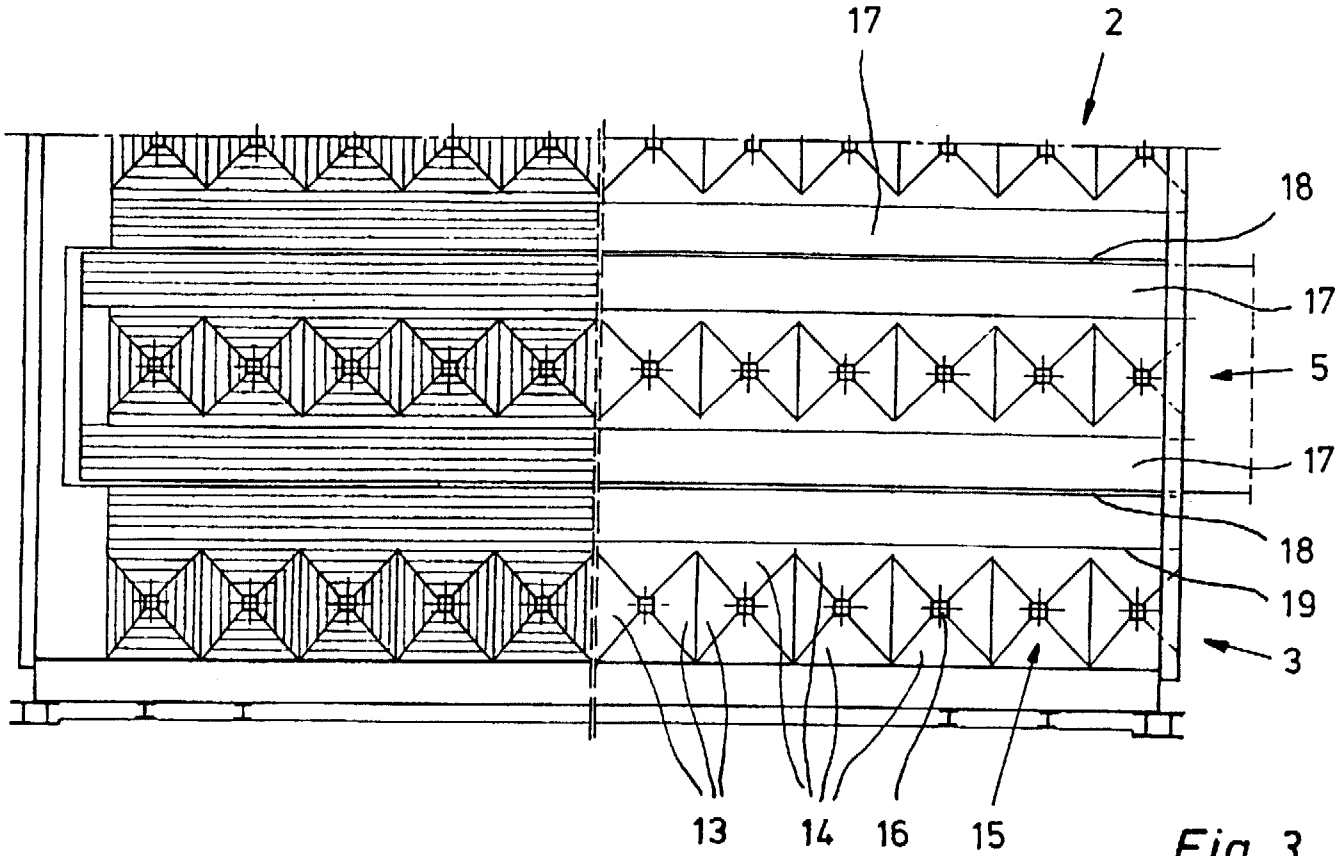
FIG. 3 a horizontal projection of half of the furnace hearth.
Figure 4:
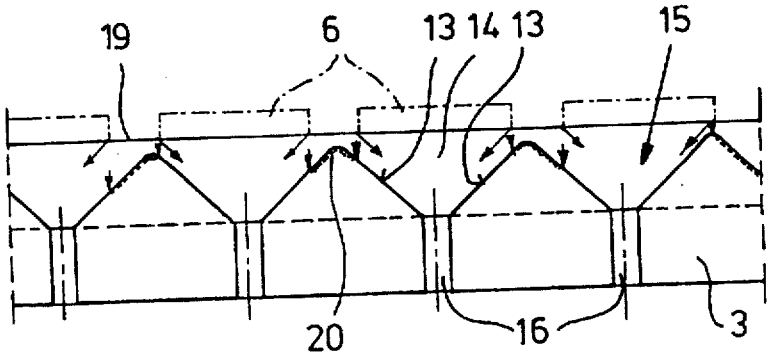
FIGS. 4–7 are vertical longitudinal partial sections of the hearth to illustrate the heating system.
Figure 5:
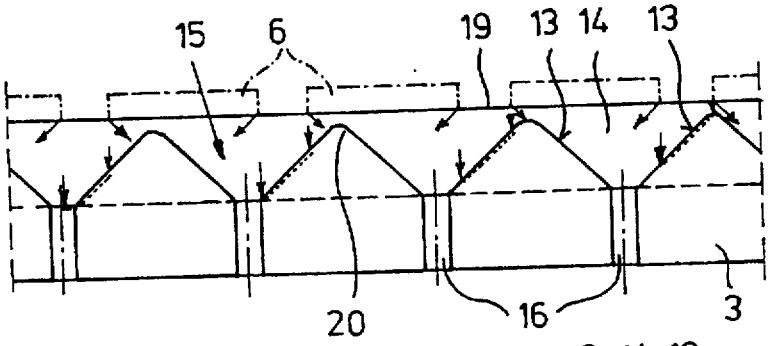
Figure 6:
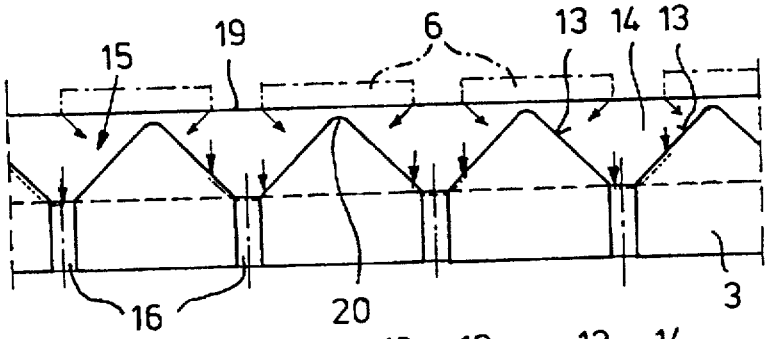
Figure 7:
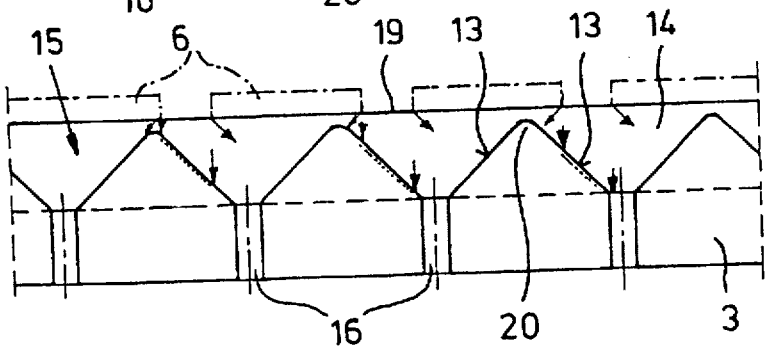

As can be seen from FIG. 3, the depressions 15 form rows running in the longitudinal direction of the furnace, the depressions being adjacent to each other. In each case of two abutting slanted surfaces 13 define a bridge 20, which, as can be seen particularly clearly from FIGS. 4 to 7, lies below the line 19 showing the hearth area. Hot gases can pass over the rows formed by the depressions 15 also in the longitudinal direction of the furnace regardless of how the pieces of work are positioned. This is particularly important when additional heating devices to intensify heating from below terminate in the depressions 15.

Referring back to FIG. 2, it shows such an additional heating device 21 in the form of a burner which terminates above the slot 18 between the fixed hearth 2 and the walking hearth 5. It is evident that it could also feed one of the depressions 15 with hot gas.

The scale which unavoidably forms is removed via the scale chutes and the slots between the hearths. To this end the slanted surfaces 13, 14 and 17 are aligned such that their angle of inclination corresponds at least to the angle of repose of the scale.

As can be seen from FIGS. 1 and 2, scale removal devices 22 are provided underneath the scale chutes 16. According to FIG. 1 they are conveyor belts.

As shown schematically in FIG. 2, the walking hearth furnace is provided with a computer-aided control device 23 which optimises the heating process. Not only the cycle time of the walking hearths and the lengths of the conveyance steps can be set but also the spacing between the pieces of work 6 (see in particular FIGS. 4 to 7).

The present invention allows a wide range of variations and combinations. For example, in contrast to FIG. 3, the depressions may be offset in relation to each other transverse to the longitudinal direction of the furnace so that the actual hearth surface area is sub-divided in sections which are also offset in relation to each other. In the embodiment described the depressions are worked into the refractory lining of the hearths. The thickness of the lining must be appropriately reinforced as otherwise heat losses would occur on the heated slanted surfaces. An alternative is to work with a normal refractory lining and to raise it by superstructures which are then provided with slanted surfaces. The form of the depressions depicted in the Figures has proved to be particularly advantageous. However, other forms are also possible.

I claim:

1. A walking hearth furnace oriented to reheat work, having a top surface and a bottom surface, as the work is transferred through the walking hearth furnace in a longitudinal direction, comprising:

a plurality of hearths that, in operation, transfer the work along the longitudinal direction, each of said plurality of hearths include at least a first slanted surface and a second slanted surface positioned to be proximate to the work;

a plurality of depressions positioned between each of said first and second slanted surfaces of said plurality of hearths and formed by at least said first and second slanted surfaces; and a plurality of heating devices oriented above said plurality of hearths, said plurality of heating devices reheating the top surface of the work and causing at least said first and second slanted surfaces to transfer heat to the bottom surface of the work.

2. The walking hearth furnace according to claim 1, wherein said plurality of hearths include at least one fixed hearth and at least one walking hearth.

3. The walking hearth furnace according to claim 1, wherein each of said plurality of depressions is pyramidal in shape and further includes a scale chute adjoined by said first and second slanted surfaces.

4. The walking hearth furnace according to claim 3, wherein a scale removal device is located below said scale chute.

5. The walking hearth furnace according to claim 1, wherein said first slanted surface is inclined in the longitudinal direction and said second slanted surface is inclined transverse to the longitudinal direction.

6. The walking hearth furnace according to claim 5, wherein each of said plurality of depressions are further formed by at least a third slanted surface adjoining a scale chute, said third slanted surface is inclined transverse to the longitudinal direction.

7. The walking hearth furnace according to claim 6, wherein at least one of said first, second and third slanted surfaces are provided with an additional heating device.

8. The walking hearth furnace according to claim 1, wherein said plurality of depressions include a first depression associated with one of said plurality of hearths and a second depression associated with a hearth adjacent to one of said plurality of hearths, said first and second depressions are offset in relation to each other transverse to the longitudinal direction of the furnace.

9. The walking hearth furnace according to claim 2, wherein the first slanted surfaces of adjoining hearths form a bridge whose height is below a refractory lining carrying the work.

10. A walking hearth furnace oriented to reheat work, having a top surface and a bottom surface, as the work is transferred through the walking hearth furnace in a longitudinal direction, comprising:

a plurality of hearths that, in operation, transfer the work along the longitudinal direction, said plurality of hearths include at least one fixed hearth having a first slanted surface and a second slanted surface, and at least one walking hearth oriented adjacent to said at least one fixed hearth, said at least one walking hearth having a third slanted surface and a fourth slanted surface;

a depression formed by at least said second slanted surface and said third slanted surface; and a plurality of heating devices oriented above said plurality of hearths, said plurality of devices reheating the top surface of the work and causing said depression to transfer heat to the bottom surface of the work.

11. The walking hearth furnace according to claim 10 wherein the depressions limited by the slanted surfaces are adjacent to each other in the longitudinal direction of the furnace.

12. The walking hearth furnace according to claim 10, wherein said depression is further formed by at least a fifth slanted surface, oriented at an incline traverse to the longitudinal direction.

13. The walking hearth furnace according to claim 12, wherein said second and third slanted surfaces are oriented at an incline in the longitudinal direction.

14. The walking hearth furnace according to claim 12, wherein said depression further includes a scale chute adjoined to said second and third slanted surfaces.

15. The walking hearth furnace according to claim 14, wherein said second, third and fifth slanted surfaces have an angle of inclination which allows a scale to fall through said scale chute.

16. The walking hearth furnace according to claim 14, wherein a scale removal device is located below said scale chute.

17. A walking hearth furnace oriented to reheat work, having a top surface and a bottom surface, as the work is transferred through the walking hearth furnace in a longitudinal direction, the walking hearth furnace comprising:

a plurality of hearths that, in operation, transfer the work along the longitudinal direction, each of said plurality of hearths include at least a first slanted surface and a second slanted surface proximate to the work and opposite of the work during transfer; and a plurality of heating devices oriented above said plurality of hearths, said plurality of heating devices reheating the top surface of the work and causing at least said first and second slanted surfaces to transfer heat to the bottom surface of the work.

18. The walking hearth furnace according to claim 17, wherein said first and second slanted surfaces are inclined at an angle of inclination which corresponds to at least an angle of repose of a scale falling from the work.

19. The walking hearth furnace according to claim 17, wherein a control device is provided with a computer to optimize reheating of the work.

20. The walking hearth furnace according to claim 17 further comprising:

a pyramidal depression positioned between said first slanted surface and said second slanted surface of each of the plurality of hearths; and a scale chute coupled to each pyramidal depression.

* * * * *

UNITED STATES PATENT AND TRADEMARK OFFICE

CERTIFICATE OF CORRECTION

PATENT NO. : 5,704,783

DATED : January 6, 1998

INVENTOR(S) : Heuss

It is certified that error appears in the above-identified patent and that said Letters Patent is hereby corrected as shown below:

On the title page, item [73] Assignee, should read "Thermprocess GmbH".

In the title page, item [63] Related U.S. Application Data, please delete " Mar. 30, 1985 " and insert -- Mar. 30, 1995 --.

In column 3 at line 27, please delete " thus " and insert -- thus, --.

Signed and Sealed this

Fifteenth Day of September, 1998

*Attest:*

*Attesting Officer*

BRUCE LEHMAN

*Commissioner of Patents and Trademarks*